United States Patent [19]

Matsuda

[11] Patent Number: 5,007,161

[45] Date of Patent: Apr. 16, 1991

[54] APPARATUS FOR FEEDING AND TRANSFERRING DISCRETE COUPLING ELEMENTS

[75] Inventor: Yasuhiko Matsuda, Toyama, Japan

[73] Assignee: Yoshida Kogyo K. K., Tokyo, Japan

[21] Appl. No.: 559,405

[22] Filed: Jul. 23, 1990

Related U.S. Application Data

[63] Continuation of Ser. No. 480,893, Feb. 16, 1990, abandoned.

[30] Foreign Application Priority Data

Feb. 21, 1989 [JP] Japan ..... 1-18398[U]

[51] Int. Cl.[5] ..... A41H 37/06

[52] U.S. Cl. ..... 29/769; 29/410; 221/210; 221/233

[58] Field of Search ..... 29/766, 769, 410; 221/210, 220, 233, 235

[56] References Cited

U.S. PATENT DOCUMENTS

| | | | |
|---|---|---|---|
| 1,903,659 | 4/1933 | Smith | 29/769 |
| 2,003,146 | 5/1935 | Gutberlett et al. | 29/769 |
| 2,034,018 | 3/1936 | Bernsteil et al. . | |
| 2,125,707 | 8/1938 | Anderson et al. | 29/769 |
| 2,144,638 | 1/1939 | Reiter | 29/769 |
| 2,217,121 | 10/1940 | Lindner | 29/769 |

FOREIGN PATENT DOCUMENTS

| | | |
|---|---|---|
| 248786 | 4/1945 | Switzerland . |
| 866106 | 6/1940 | United Kingdom . |
| 642803 | 4/1949 | United Kingdom . |

*Primary Examiner*—P. W. Echols

*Attorney, Agent, or Firm*—Hill, Van Santen, Steadman & Simpson

[57] ABSTRACT

An apparatus for feeding and transferring discrete coupling elements successively one at a time for attachment onto a stringer tape comprises a feed unit including a vertically disposed feed chute and a transfer unit including first and second slides both supported on a base for horizontal movement effected by a cam. The thickness of the first slide is substantially equal to the height of the leg portions of the element. A pocket is formed in the junction of the first and second slides for receiving an element from the chute and communicates with a slit in the base which provides a suction air for facilitating the fall by gravity of a leading element apart from an ensuing element. The base includes a transfer chute for receiving one element from the pocket and transferring same onto the tape.

6 Claims, 4 Drawing Sheets

APPARATUS FOR FEEDING AND TRANSFERRING DISCRETE COUPLING ELEMENTS

This is a continuation of application Ser. No. 480,893, filed Feb. 16, 1990, abandoned.

BACKGROUND OF THE INVENTION

1. Field of the Invention

This invention relates to an apparatus for feeding coupling elements for attachment to slide fastener stringers and particularly such an apparatus which is designed to feed and transfer a number of discrete coupling elements successively one at a time to an element attaching station in a slide fastener manufacturing plant.

2. Prior Art

Feeding apparatuses of the character to which the invention pertains have been proposed as disclosed for example in U.S. Pat. Nos. 1,903,659 and 2,125,707 wherein a series of discrete fastener coupling elements each having a head portion and a pair of bifurcated leg portions are let fall by gravity feed through a vertically disposed chute and transferred one at a time with the bifurcated leg portions directed downwardly toward a longitudinal edge of a stringer tape, in which instance a leading or endmost one of the coupling elements is temporarily arrested by a resilient member at the bottom end of the chute and separated from an ensuing element by a vertically reciprocative pawl which then forces the leading element downwardly against the bias of the pawl and mount the same on the tape with its leg portions astride over the tape edge. Since the pawl is arranged to intrude between the head portion of the leading element and the bifurcated leg portions of the ensuing element, the prior art device cannot cope with the case where an array of coupling elements is meandered or otherwise misaligned in the chute, or where the type of elements is such that the leg portions of the ensuing element are fitted snugly over the head portion of the leading element. Another difficulty of the prior art is that due to forcible feed of the element which is resiliently arrested by the resilient member, the element is susceptible to damage. This problem would be more critical when handling fastener elements which are plated or chemically treated.

SUMMARY OF THE INVENTION

It is therefore the primary object of the present invention to provide an apparatus for feeding and transferring slide fastener elements which will eliminate the foregoing difficulties of the prior art.

A more specific object of the invention is to provide an apparatus for feeding slide fastener elements which is capable of transferring a series of discrete coupling elements successively one at a time efficiently and accurately onto a stringer tape without impairing the elements.

According to the invention, there is provided an apparatus for feeding and transferring discrete coupling elements each having a head portion and a pair of bifurcated leg portions successively one at a time onto a stringer tape, which apparatus comprises a feed unit including a vertically disposed feed chute having an elongate vertical opening, a transfer unit including a first slide and a second slide both supported on a base for horizontal reciprocating movement and defining therebetween a pocket registrable with the vertical opening, a transfer chute integrand with the base and having a vertical opening for receiving an element from the pocket and transferring the same onto the tape, and means connected to the second slide and adapted to effect horizontal reciprocating movement of the slides.

The above and other objects and features of the invention will be more apparent from the following detailed description taken in conjunction with the accompanying drawings.

DETAILED DESCRIPTION OF THE INVENTION

Figure 1:
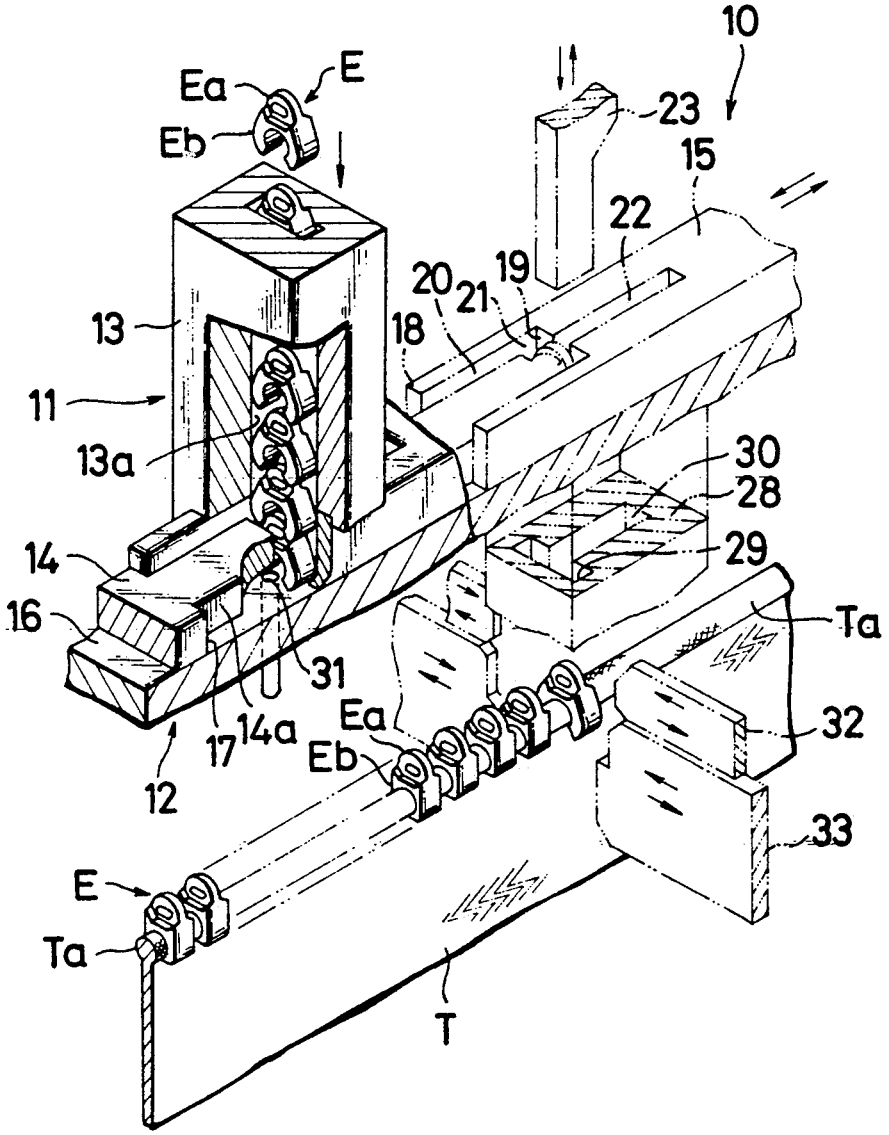
FIG. 1 is a perspective view of an apparatus for feeding and attaching a series of coupling elements onto a stringer tape which is constructed in accordance with the principles of the invention.

Referring now to the drawings and FIG. 1 in particular, there is shown an apparatus 10 embodying the invention which comprises a feed unit 11 and a transfer unit 12. The feed unit 11 includes a vertically disposed feed chute 13 having an elongate vertical opening **13*a*** dimensioned to accommodate a number of vertically aligned coupling elements E supplied from a parts feeder or hopper located up above (not shown). The elements E are made of a metallic or other pliable material and each have a coupling head portion Ea and a pair of bifurcated leg portions Eb. They are let fall by their own gravity in succession with the leg portions Eb of one element E directed downwardly in confrontation with the head portion Ea of a preceding element E.

The transfer unit 12 comprises a first or feed slide 14 and a second or feedback slide 15 both supported on a base 16 for horizontal reciprocating movement thereon. The first slide 14 has a rear end **14*a* recessed from both sides to form abutments 17 for abutting engagement with respective ends of a pair of spaced longitudinal arms 18 integral with the second slide 15 and defining therebetween and with a transverse shoulder wall 19 a rectangular opening 20 for receiving the first slide 14. When the arms 18 are brought into abutting engagement with the abutments 17, the first slide 14 is disposed with its front end wall 14*b* spaced from the shoulder wall 19 of the second slide 15 so as to provide a pocket 21** dimensioned to receive a coupling element E of a given size.

An elongate longitudinal slot 22 is formed in the second slide 15 in communication with the square opening 20 for receiving therethrough a vertically movable positioning bar 23 later described.

A compression spring 24 is connected to the rear end 14*a* of the first slide 14 for normally urging the latter toward the second slide 15.

Figure 3:
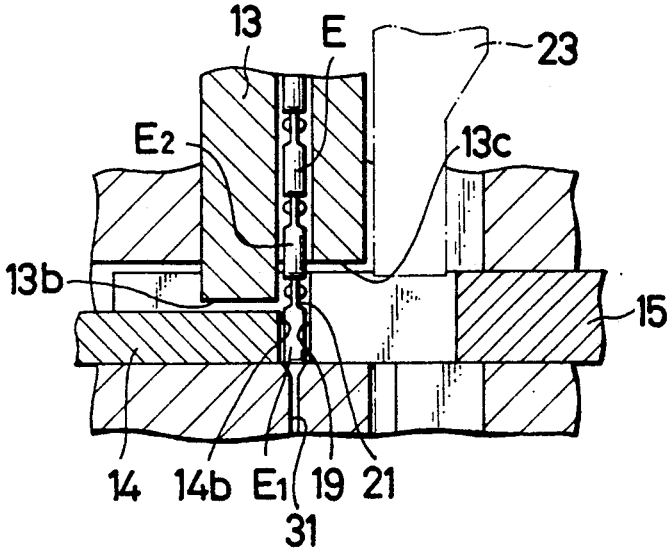
FIG. 3 is a diagrammatic sectional view of a portion of the apparatus of FIG. 1, schematically showing the apparatus in one phase of operation.
Figure 4:
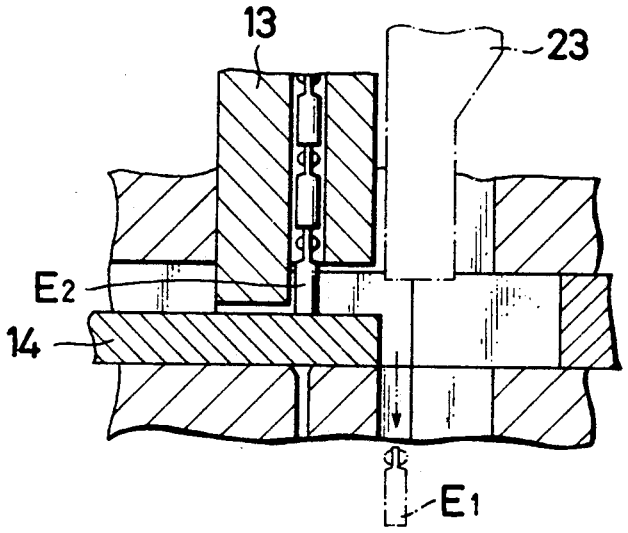
FIG. 4 is a view similar to FIG. 3 but showing the apparatus in another phase of operation.

As better shown in FIGS. 3 and 4, the bottom end of the chute 13 is spaced from the upper surface of the base 16 with an upstream or left side half end portion 13*b* (as viewed in the drawings) spaced by a distance slightly shorter than the height of the element E and a downstream or right side half end portion 13*c* spaced by a distance slightly longer than the height of the element E such that the first slide 14 can move a leading or lowermost element $E_1$ forwardly without interference to a next ensuing element $E_2$ and that the second slide 15 can move clear past the downstream side of the chute 13 and cause the first slide 14 to retract to the original feed position against the tension of the spring 24. To this end, the thickness of the first slide 14 is substantially equal to the height of the leg portions Eb of the element E.

Figure 2:
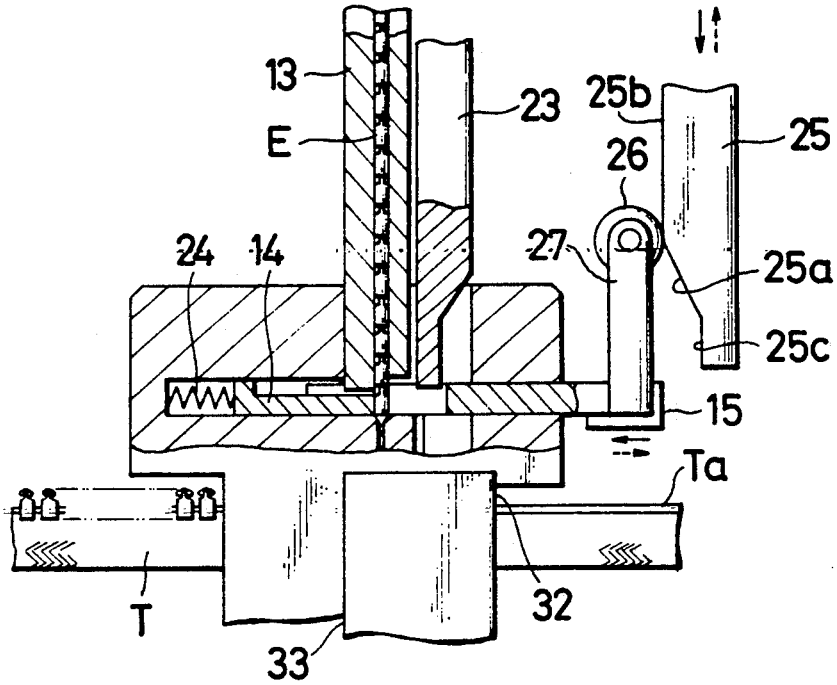
FIG. 2 is a diagrammatic sectional view of a major portion of the apparatus of FIG. 1.

Horizontal movement of the second slide 15 is effected by a controlled drive means comprising a drive cam 25 and its associated cam follower 26 as shown in FIG. 2. The cam 25 is in the form of a generally rectangular plate having a downwardly sloped cam surface 25*a* and vertical straight cam surfaces 25*b* and 25*c* and the cam follower 26 is in the form of a roller supported rotatably on one end of a vertical bar 27 whose other end is secured to the rear end of the second slide 15. The cam 25 is vertically moved by suitable drive means not shown.

When the cam 25 moves upwardly with its sloped cam surface 25*a* coming into sliding engagement with the cam follower 26, the second slide 15 is moved rightward (as viewed in the drawings) or progressively retracted away from the chute 13 by the action of the compression spring 24. Conversely, downward movement of the cam 25 with its sloped cam surface 25*a* in contact with the cam follower 26 causes the second slide 15 to move leftward (as viewed in the drawings) or progressively advance toward the chute 13.

Designated at 28 is an element receiving and transfer chute integral with and extending downwardly from the base 16 and having a vertical opening 29 for receiving an element E and an elongate slot 30 registrable with the slot 22 in the second slide 15 for the passage therethrough of the positioning bar 23.

Designated at 31 is a slit formed in the base 16 in registry with the opening 13*a* of the feed chute 13 for providing a suction air from a suction device (not shown) whereby a leading element $E_1$ is attracted into the pocket 21 in the second slide 15.

Figure 5:
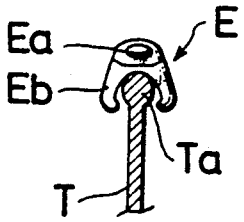
FIG. 5 is a diagrammatic elevational view of a coupling element mounted astride a tape edge.
Figure 6:
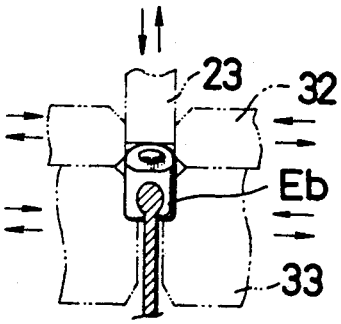
FIG. 6 is a diagrammatic elevational view of the coupling element shown clamped onto the tape.

With this construction of the apparatus 10, a leading fastener element $E_1$ is let fall by gravity (with the aid of the suction air through the slit 31) into the pocket 21 as shown in FIG. 3, whereupon the cam 25 is actuated in one direction so as to move the slides 14 and 15 forwardly until the leading element $E_1$ comes in registry with and falls through the opening 29 as shown in FIG. 4. The element $E_1$ is then mounted on a stringer tape T with its bifurcated legs Eb astride over a longitudinal beaded edge Ta of the tape as shown in FIG. 5. The element E, as it is mounted on the tape T, is held in place by the positioning bar 23 which has descended through the slots 22 and 30 and by a pair of retaining bars 32, 32 and clamped firmly to the tape T by a pair of punches 33, 33 as shown in FIG. 6. This is followed by inching movement of the tape T for a distance substantially corresponding to one element E in the direction of the arrow as shown in FIG. 1. This inching movement is timed with the actuation of the cam 25 in the other direction so as to move the slides 14 and 15 backwardly to their original positions shown in FIGS. 2 and 3 with the pocket 21 aligned with the opening 13aof the feed chute 13 for receiving the next succeeding element $E_2$ from the feed chute 13.

Figure 7:
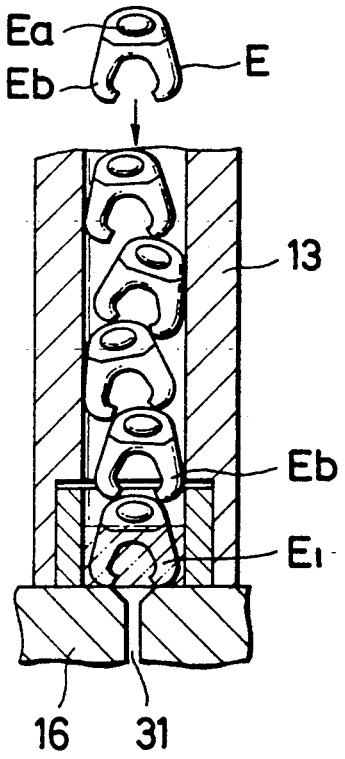
FIG. 7 is a diagrammatic sectional view of a lower portion of a supply chute, schematically showing a succession of coupling elements arrayed out of alignment.
Figure 8:
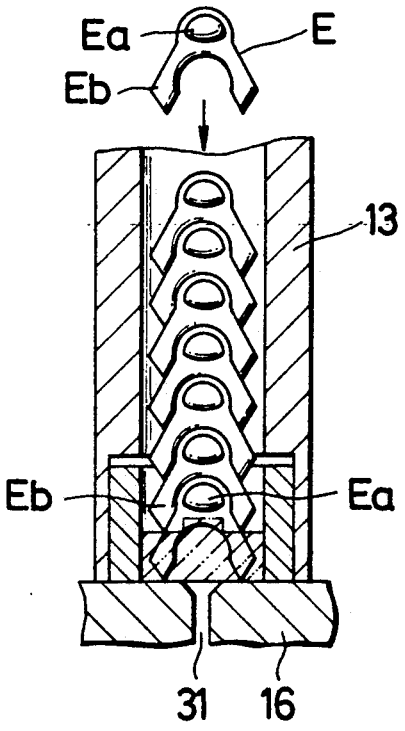
FIG. 8 is a diagrammatic sectional view similar to FIG. 7 but showing a series of coupling elements configured to fit snugly with each other.

The above cycle of operation is repeated whereby discrete coupling elements E are fed, transferred and attached in succession to the stringer tape T, and this operation can be carried out efficiently and accurately even in the event that the elements E are malaligned as shown in FIG. 7, or the elements E are shaped to fit snugly over each other as shown in FIG. 8.

Obviously, various modifications and variations of the present invention are possible in the light of the above teaching. It is therefore to be understood that within the scope of the appended claims the invention may be practiced otherwise than as specifically described.

What is claimed is:

1. An apparatus for feeding and transferring discrete coupling elements each having a head portion and a pair of bifurcated leg portions successively one at a time onto a stringer tape, which apparatus comprises a feed unit including a vertically disposed feed chute having an elongate vertical opening, a transfer unit including a first slide and a second slide both supported on a base for horizontal reciprocating movement and defining therebetween a pocket registrable with said vertical opening, a transfer chute integral with said base and having a vertical opening for receiving an element from said pocket and transferring the same onto said tape, and means connected to said second slide and adapted to effect horizontal reciprocating movement of said slides.

2. An apparatus according to claim 1 wherein said base has a vertical slit located in registry with said opening and adapted to provide a suction air to attract a leading one of said elements into said pocket.

3. An apparatus according to claim 1 further including a compression spring normally urging said first slide toward said second slide and operatively associated with said means.

4. An apparatus according to claim 1 wherein said means comprise a vertically movable plate cam having a downwardly sloped cam surface and a cam follower in the form of a roller rotatable in contact with said cam.

5. An apparatus according to claim 1 wherein said chute has its bottom end spaced from said base with an upstream half end portion spaced by a distance slightly shorter than the height of said element and with a downstream half end portion spaced by a distance slightly longer than the height of said element.

6. An apparatus according to claim 1 the thickness of said first slide is substantially equal to the height of the leg portions of said element.

* * * * *